United States Patent [19]

Hatakeyama et al.

[11] Patent Number: 4,713,024

[45] Date of Patent: Dec. 15, 1987

[54] CONNECTOR FOR TELEVISION DISTRIBUTION EQUIPMENT

[75] Inventors: Takuya Hatakeyama, Chiba; Shinji Ohga, Tokyo, both of Japan

[73] Assignee: Uro Denshi Kogyo Kabushiki Kaisha, Tokyo, Japan

[21] Appl. No.: 891,878

[22] Filed: Jul. 30, 1986

[30] Foreign Application Priority Data

Jul. 30, 1985 [JP] Japan ..... 60-115897

[51] Int. Cl.[4] ..... H01R 13/73

[52] U.S. Cl. ..... 439/555; 439/557; 439/581

[58] Field of Search ..... 339/126 J, 126 RS, 126 R, 339/17 C, 17 R, 17 LC, 177 R, 177 E, 182, 183, 59, 61, 63, 193 R, 196 M, 206 R, 206 P, 207, 210 R, 210 M, 211, 217 R, 217 S

[56] References Cited

U.S. PATENT DOCUMENTS

| | | | |
|---|---|---|---|
| 2,919,421 | 12/1959 | Modrey | 339/126 RS |
| 3,173,736 | 3/1965 | Brinkel et al. | 339/217 S |
| 3,564,478 | 2/1971 | Hampton | 339/217 S |
| 3,845,453 | 10/1974 | Hemmer | 339/217 S |
| 4,296,992 | 10/1981 | Gallagher | 339/206 R |
| 4,361,376 | 11/1982 | Galluser et al. | 339/206 R |

FOREIGN PATENT DOCUMENTS 3218111 12/1982 Fed. Rep. of Germany ... 339/206 P

*Primary Examiner*—Eugene F. Desmond
*Assistant Examiner*—David Pirlot
*Attorney, Agent, or Firm*—Robert E. Burns; Emmanuel J. Lobato

[57] ABSTRACT

A connector for distribution equipment, comprising a cylindrical outer conductor fixed to a casing, a substantially cylindrical insulator inserted in the outer conductor, an inner resilient conductive member inserted and so retained in the insulator, porjections provided radially inward on an opening formed on a portion through which an internal space of the casing and an internal space of the outer conductor communicate with each other, and flexible legs provided projectingly further rearward of a rear end surface of the insulator and having claws formed radially outward on the nose portion thereof. The insulator is inserted in the outer conductor with the flexible legs bent radially inward, and, as a result of the returning of the legs at instant when the claws of the leg come in across the projection of the opening, the insulator can be mounted and so fixed in the outer conductor through engagement of the claws and the projections.

7 Claims, 4 Drawing Figures

CONNECTOR FOR TELEVISION DISTRIBUTION EQUIPMENT

BACKGROUND OF THE INVENTION

The present invention relates to distribution equipment such as splitters and directional couplers for TV signals used for TV community receiving facilities and is particularly concerned with a connector to which a coaxial cable is connected.

An electrical coaxial connector is fixed on a casing of distribution equipment with circuit parts such as a printed wiring board installed therein, and external signals are transmitted to the circuit parts from a coaxial cable by way of this coaxial connector.

Generally, the electrical coaxial connector is provided with an outer cylindrical conductor to which an outer conductor (outer braid conductor normally) provided around the coaxial cable for grounding is connected, an almost cylindrical insulator inserted in the outer conductor, and an inner resilient conductive member inserted and fixed in the insulator and having an internal conductor (center conductor normally) for transferring signals of the coaxial cable inserted and so connected therein.

Screw threads are formed on the outer periphery of the outer conductor, and the coaxial cable can be connected and fixed to the coaxial connector of the distribution equipment by screwing a connecting nut for the coaxial cable which is provided through the outer braid conductor on the threads. The outer conductor of the coaxial connector and the outer braid conductor of the coaxial cable are connected for conduction to each other by connecting and fixing the coaxial cable to the coaxial connector, and the inner resilient conductive member of the coaxial connector and the internal conductor of the coaxial cable are also connected for conduction at the same time.

The insulator functions to fix and hold the inner resilient conductive member at the central position of the outer conductor with the two parts kept insulated electrically from each other, and is inserted and fixed in the outer conductor. A conventional method for inserting and fixing the insulator in the outer conductor comprises providing a stopper on the inner part (in the direction inside the casing) of the outer conductor, inserting the almost cylindrical insulator until it comes into contact with the stopper, pressing an inlet end portion of the outer conductor radially inward to cause deformation (calking), and calking an end portion of the insulator to fix the same.

However, such a method for fixing the insulator by calking the inlet end portion of the outer conductor is not only unsatisfactory since it spoils the appearance as a consequence of an uneven shape on the calked portion but also gives rise to cracks in the calked portion in the case where the outer conductor is made of a material which cannot easily undergo plastic deformation. On the other hand, since a calking process is included in the assembling process of the distribution equipment, the assembling work becomes complicated.

SUMMARY OF THE INVENTION

In view of the above described problems prevailing in the prior art, an object of the invention is to provide a connector for distribution equipment which is capable of facilitating positive assembly of the distribution equipment.

According to the invention, in a connector for distribution equipment provided with a hollow cylindrical outer conductor fixed on a casing of the distribution equipment, an outer braid conductor of a coaxial cable is connectable to the outer conductor, a substantially hollow cylindrical insulator inserted in the outer conductor, and an inner resilient conductive member inserted and held in the insulator, an internal conductor of the coaxial cable is connectable to the inner resilient conductive member, there is provided the improvement wherein a plurality of projecting members directed radially are provided around an opening through which a space in the casing and a space in the outer conductor communicate with each other, and a plurality of flexible legs each having a claw formed radially outward on its nose portion are provided on the insulator projectingly further rearward of a rear end surface of the insulator.

According to the connector of the invention, with the flexible legs of the insulator bent radially inward, the insulator is inserted in the outer conductor, and from returning the legs at the point in time when the leg claws come in over the projecting members of the opening, the insulator can be mounted and so fixed simply and easily in the outer conductor through engagement of the claws with the projecting members. According to this method for assembling the insulator, an unreasonable force is not exerted on the outer conductor, whereby the outer conductor can thus be prevented from being deformed or damaged, and the assembling work can be carried out quickly.

DESCRIPTION OF THE PREFERRED EMBODIMENT

Figure 1:
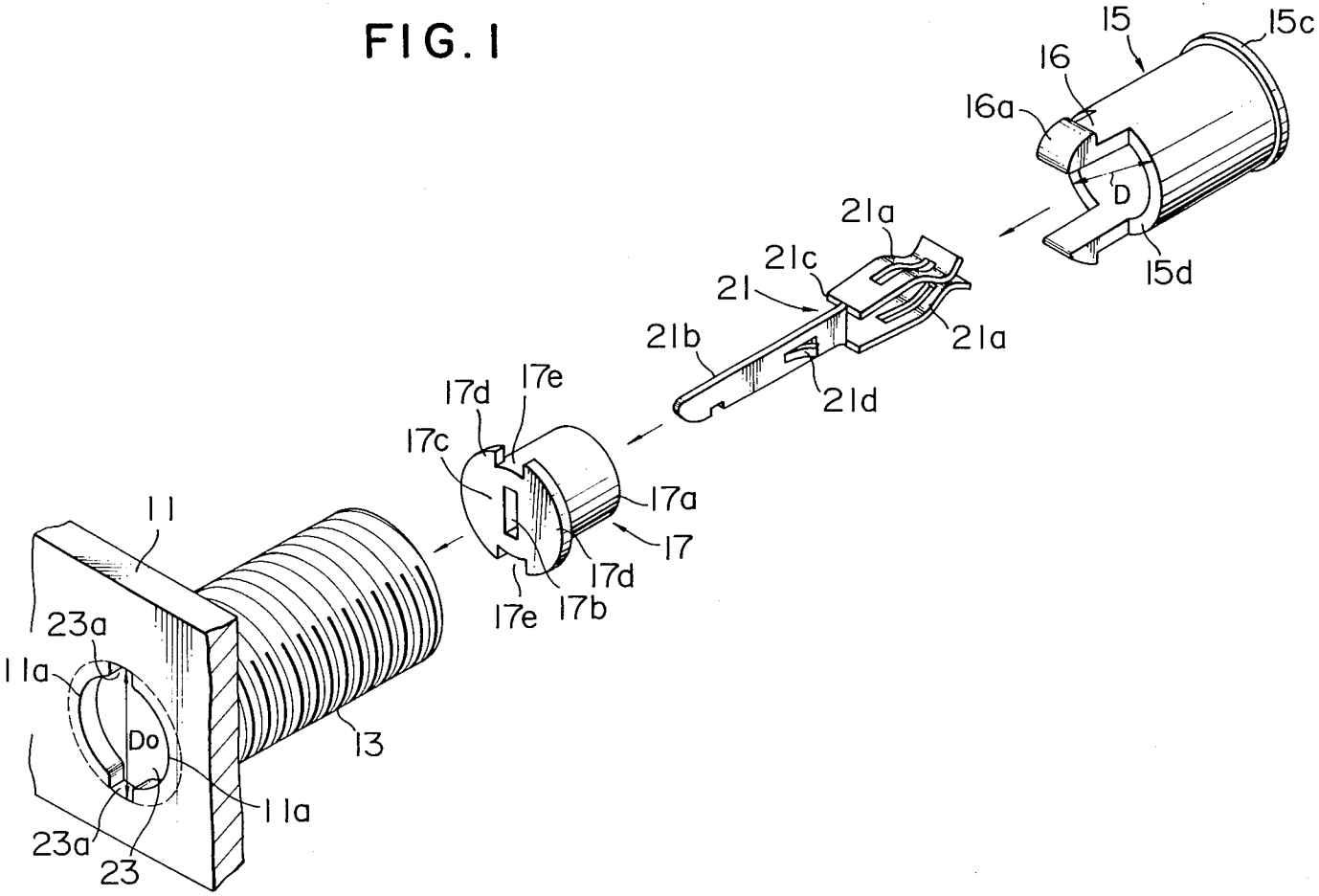
FIG. 1 is an exploded perspective view showing a connector for television distribution equipment according to the invention.
Figure 2:
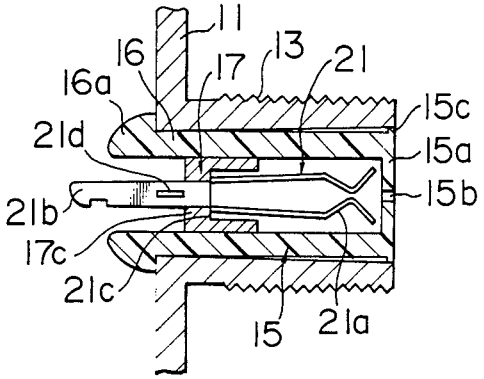
FIGS. 2 and 3 are sectional views thereof, representing a section taken on line II—II of FIG. 4 and a section taken on line III—III, respectively.
Figure 3:
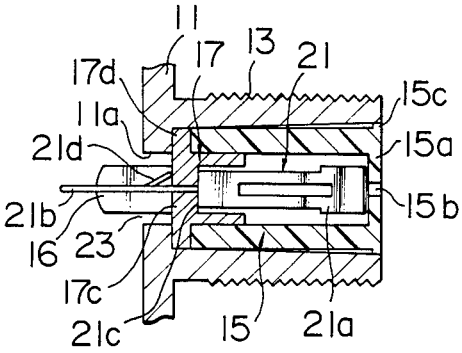

Referring now in detail to the drawings illustrating an example of the invention, reference numeral 11 denotes the casing of a distribution equipment. An outer cylindrical conductor 13 with a threaded zone formed on its outer periphery to which an outer braid conductor 31 of a coaxial cable 30 (FIG. 4) is connectable through a nut 32 is fixed to a wall surface of the casing 11. The outer braid conductor 31 functions as a grounding conductor, which is inserted conductively in a net-like nut 32. While the outer conductor 13 is formed integrally with the casing 11 in the example, the outer conductor 13 can be formed from a member other than the casing 11 and then fixed to the casing 11. The interior of the outer conductor 13 is formed with its inner diameter gradually increasing toward an inlet end (end into which the internal conductor of the coaxial cable is inserted) from a mounting side to the casing 11 so that the insulator can be inserted easily for assembly. A substantially hollow cylindrical insulator comprising an outside insulator 15 inserted and so retained to come in contact with the inner wall surface of the outer conductor 13 and an inside insulator 17 fitted and so retained in the outside insulator 15 and holding an inner resilient conductive member 21 at the central portion is inserted and so retained in the outer conductor 13.

The outside insulator 15 is of hollow cylindrical shape with an open rear end, and a hole 15*b* through which an internal conductor 33 of the coaxial cable 30 is inserted is formed at the center of a front end wall surface 15*a* thereof. A flange 15*c* with an outer diameter equal to the inlet end diameter of the outer conductor 13 is formed radially on the outer periphery of the outside insulator. Further, a pair of flexible legs 16 are provided on the rear end surface 15*d* and project further rearward. A claw 16*a* is formed radially outward on the rear nose portion of each leg 16.

The inside insulator 17 comprises a cylindrical body 17*a* fitted in the outside insulator 15 with its one end open, an end wall 17*c* formed at the other end of the body 17*a* and provided with a slot through hole 17*b* for holding the inner resilient conductive member therein, and a pair of flange-like members 17*d* provided to project radially outward from the outer periphery of the end wall of the body 17*a*.

The inner diameter of the outside insulator 15 is made to fit the outer diameter of the body 17*a* of the inside insulator 17, and the outer diameter D of the outside insulator 15 is made to fit the outer diameter of the flange-like member 17*d* of the inside insulator 17. Further, each of the circumferential gaps 17*e* between the pair of flange-like members 17*d* is made slightly larger than the circumferential width of the claw 16*a* of the outside insulator 15. By the above described configuration, the paired legs 16 are inserted through the gap 17*e* of the inside insulator 17, whereby the inside insulator 17 can be fitted and retained in the outside insulator 15, and also the insulator thus assembled can be inserted in the outside conductor 13.

The inner resilient conductive member 21 comprises a pair of push pieces 21*a* between which the internal conductor 33 of the coaxial cable 30 is inserted and so retained and a junction piece 21*b* formed extendedly from the push pieces 21*a* and connected to an electric circuit in the distribution equipment. A stepped portion 21*c* is formed at the junction of each push piece 21*a* and the junction piece 21*b* by connecting the junction piece 21*b* transversely to the push piece 21*a*, and further a return locking part 21*d* is provided at a middle part of the junction piece 21*b*.

A pair of protrusions 11*a* directed radially inward are provided with a gap 23*a* left therebetween in the circumferential direction at an opening 23 formed at a portion where the interior space of the casing 11 and the interior space of the outer conductor 13 communicate with each other. Then, in the example shown in FIG. 1, since the opening 23 is provided on a wall surface of the casing 11, the protrusions 11*a* are formed as partial extensions of the casing 11. However, in case where the outer conductor 13 is constituted of a member separated from the casing 11, the opening may be formed at the end portion of the outer conductor 13, in which case the protrusions can be formed as partial extensions of the outer conductor 13.

The circumferential width of the gap 23*a* is made somewhat larger than the circumferential width of the claw 16*a* of the outside insulator 15, and the maximum diameter D of the opening 23 at the position where the paired gaps 23*a* are provided is made identical to the outer diameter D of the outside insulator 15.

At outer nose of each claw 16*a* and the end portion of each protrusion 11*a* are formed to have a smooth curvilinear surface, thereby permitting the claw 16*a* to pass easily through the gap 23*a* of the paired protrusions 11*a*.

Described next is the process of assembling the connector for distribution equipment according to the invention of the above described construction.

First, the junction piece 21*b* of the inner resilient conductive member 21 is inserted through the inside insulator 17 from its opening side to come out of the through hole 17*b*. The inner resilient conductive member 21 is fixed and so retained in the inside insulator 17 while the vertical wall 17*c* of the inside insulator 17 is held between the locking piece 21*d* and the stepped portion 21*c*. Then, the body 17*a* of the inside insulator 17 is inserted into the outside insulator 15 from the rear opening of the outside insulator 15. The claw 16*a* and the leg 16 of outside insulator 15 are passed through the gap 17*e* provided between the flange-like members 17*d* of the inside insulator 17, the flange-like members 17*d* coming into contact with the rear end surface 15*d* of the outside insulator 15, and thus the inside insulator 17 is fitted and assembled in the outside insulator 15.

The insulator assembled as above is inserted in the outer conductor 13 from the inlet side of the outer conductor 13 with its leg 16 coming ahead. Since the outermost end size of the paired claws 16*a* is made larger than the inner diameter of the outer conductor 13, the legs 16 are inserted in a state wherein they are bent radially inward, and when the claws 16*a* reach the internal space position of the casing 11 through the gap 23*a* of the opening 23, the legs 16 return radially by elasticity, the claws 16*a* engaging with the inner wall surface of the casing 11. Then the flange-like members 17*d* of the inside insulator 17 come in contact with the protrusions 11*a* of the opening 23, thus stopping the insulator from entering further. Further, the inlet end of the outer conductor 13 is blocked by the flange 15*c* of the outside insulator 15.

In the connector structure thus assembled, the claws 16*a* engage with the inside wall surface of the casing 11, the flange-like members 17*d* of the inside insulator 17 coming into contact with the protrusions 11*a*, and thus the insulator is fixed axially in the outer conductor 13. Then, since the legs 16 pass through the gaps 17*e* of the inside insulator 17 and the gaps 23*a* of the opening 23, the insulator is fixed in the circumferential direction in the outer conductor 13, and the inner resilient conductive member 21 is so positioned.

Figure 4:
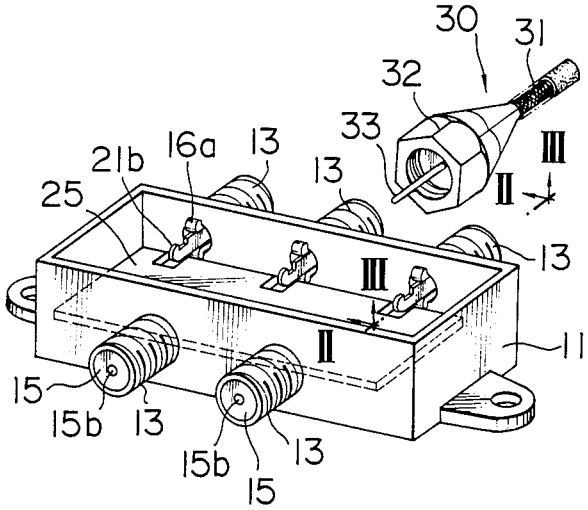
FIG. 4 is a perspective view representing one example of distribution equipment provided with the connector according to the invention.

FIG. 4 represents one example of the connector structure for distribution equipment which is assembled as described above. The junction piece 21*b* of the inner resilient conductive member 21 let in the casing 11 is connected electrically through soldering to a printed wiring board 25 disposed in the casing 11.

The coaxial cable 30 is inserted between the paired push pieces 21*a* of the inner resilient conductive member 21 through the hole 15*b* of the internal conductor 33 and is connected to the distribution equipment by screwing the nut 32 onto the outer conductor 13. The outer conductor 13 and the outer braid conductor 31 of the coaxial cable 30 are connected through the nut 32, and the distribution equipment is grounded. Further, signals to the printed wiring board 25 are operated from the internal conductor 33 of the coaxial cable 30 through the inner resilient conductive member 21.

According to the invention, the insulator and the inner resilient conductive member retained thereon can be incorporated and so fixed simply and easily without applying an external force such as calking or the like to the outer conductor.

What is claimed is:

1. A connector for distribution equipment, comprising:

a cylindrical outer conductor fixed on a casing of the distribution equipment, an outer braid conductor of a coaxial cable being connectable to said outer conductor;

a substantially cylindrical insulator inserted in said outer conductor;

an inner resilient conductor member inserted and held in said insulator, an internal conductor of said coaxial cable being connectable to said inner resilient conductive member;

a plurality of projecting members extending radially inward in mutually opposed state around an opening through which a space in said casing and a space in said outer conductor communicate with each other; and a plurality of flexible legs having respective claws formed radially outward on nose portions thereof, said legs being provided on said insulator and projecting further rearward of a rear end surface of the insulator.

2. The connector for distribution equipment as defined in claim 1 wherein the projecting members extending radially inward are provided at at least two positions.

3. The connector for distribution equipment as defined in claim 2 wherein the projecting members extending radially inward are provided to have a circumferential gap through which the legs of said insulator are insertable.

4. The connector for distribution equipment as defined in claim 1 wherein said insulator comprises an outside insulator inserted and so retained as to come into contact with an inner wall surface of the outer conductor and an inside insulator fitted and so retained in said outside insulator and having said inner resilient conductive member at the central portion thereof.

5. The connector for distribution equipment as defined in claim 4 wherein the legs are provided projectingly further rearward of a rear end surface of said outside insulator.

6. The connector for distribution equipment as defined in claim 4, wherein said inside insulator comprises a cylindrical body fitted in the outside insulator with one end open, an end wall formed on the other end of said body orthogonally to the axis of said body and provided with a through hole for holding the inner resilient conductive member, and flange-like members provided projectingly around and radially outward from said body.

7. The connector for distribution equipment as defined in claim 4 wherein the interior of the outer conductor is formed with its diameter gradually increasing toward an inlet end side from a casing mounting side, and a flange fitted in the interior on the inlet side of said outer conductor is formed on an outer periphery on a front end side of the outside insulator.

* * * * *